United States Patent [19]

Berg

[11] 4,264,888

[45] Apr. 28, 1981

[54] MULTIPASSAGE RESISTOR AND METHOD OF MAKING

[75] Inventor: Peter G. Berg, Attleboro Falls, Mass.

[73] Assignee: Texas Instruments Incorporated, Dallas, Tex.

[21] Appl. No.: 35,889

[22] Filed: May 4, 1979

[51] Int. Cl.[3] ..... H01C 7/02

[52] U.S. Cl. ..... 338/25; 29/610 R; 29/621; 219/307; 219/505; 338/327; 338/333

[58] Field of Search ..... 338/25, 308, 309, 327, 338/333; 219/381, 375, 377, 307, 541, 543; 29/621, 610

[56] References Cited

U.S. PATENT DOCUMENTS

| | | | |
|---|---|---|---|
| 3,927,300 | 12/1975 | Wada et al. | 338/22 R X |
| 3,982,100 | 9/1976 | Hervert | 219/543 X |
| 4,107,515 | 8/1978 | Kulwicki | 338/22 R X |
| 4,180,901 | 1/1980 | Kulwicki | 338/225 D X |

*Primary Examiner*—C. L. Albritton

*Attorney, Agent, or Firm*—James P. McAndrews; John A. Haug; Melvin Sharp

[57] ABSTRACT

A resistor particularly useful as a self-regulating fluid heater has passages extending through a body of ceramic resistance material of positive temperature coefficient of resistivity (PTC) and has ohmic contact coatings formed on the inner walls of the passages. The passage walls define thin webs of the resistance material between adjacent passages and are of uniform thickness end to end. Slits located in the walls at the ends of selected passages accommodate electrically conducting means which interconnect the contacts in selected pairs of the passages. In that way, predetermined groups of the contacts are interconnected at respective ends of the resistor so that when the groups of contacts are connected in a circuit, electrical current is directed through the thin webs of resistance material between contacts of opposite polarity in adjacent passages, thereby to heat the resistor to self-regulate its temperature to efficiently generate heat for transfer to a fluid directed through the passages. Electrically conductive coatings are applied to the ends of the resistor body to be received in the slits and the body ends are then abraded for removing coating material outside the slits, thereby to interconnect the desired groups of contacts.

12 Claims, 6 Drawing Figures

MULTIPASSAGE RESISTOR AND METHOD OF MAKING

BACKGROUND OF THE DISCLOSURE

Resistors having passages extending through a body of ceramic resistance material of positive temperature coefficient of resistivity have been proposed for use as fluid heaters. Such heaters are safe and self-regulating and are adapted to generate high volume outputs of heated air for a hair dryer or the like or to safely and efficiently heat the air-fuel mixture being supplied to an automobile engine to assure early volatilization of the fuel before the mixture is furnished to the engine. In one such device, ohmic contact coatings are formed on the inner walls of the resistor body passages and selected groups of the contact coatings are interconnected so that electrical current can be directed through the thin webs of resistance material between contacts of opposite polarity in adjacent body passages, thereby to generate a large amount of heat for efficient transfer to a fluid directed through the passages. In one particularly advantageous structure of that type, interconnection of the desired groups of ohmic contact coatings is facilitated by molding thin lands of the resistance material around alternate ones of the passages at one end of the resistor body. Similar lands are molded around the ends of the other passages at the opposite end of the resistor. Coatings of electrically conductive interconnecting materials are then applied to the ends of the resistor so that all of the ohmic contacts are connected together at each end of the body. The body ends are then abraded for conveniently removing the interconnection coating material from the tips of the lands, thereby to leave two groups of ohmic contacts interconnected by the conductive material which remains on the ends of the body around the sides of the lands or between the lands.

Frequently, however, such resistor heater devices are difficult and expensive to manufacture. For example, in the last noted structure, the lands tend to chip during handling either before application of the interconnection coating material or during the abrading steps or the like with the result that some of the devices are found to be defective. The provision of the lands also tends to complicate the molding of the resistor body. In addition, providing the lands necessitates the use of relatively thicker passage walls than would otherwise be required, thereby resulting in higher resistance in the webs of resistance material as the resistor heater is initially energized. As will be understood, the use of thicker walls also requires the use of a larger volume of the resistance material than might otherwise be necessary for achieving a selected heating capacity.

It is an object of this invention to provide a novel and improved multi-passage resistor; to provide such a resistor adapted for use as a fluid heater which is formed of a multipassaged body of ceramic resistance material of positive temperature coefficient of resistivity having ohmic contact coatings formed on the inner walls of the body passages and having novel and improved means electrically interconnecting selected groups of the contacts with improved convenience and reliability; to provide such resistor heater devices which embody relatively lesser volumes of resistance material and which display relatively lower resistance when initially energized; to provide such devices which are of a compact and rugged structure; and to provide such devices which are relatively inexpensive to manufacture.

SUMMARY OF THE INVENTION

Briefly described, the novel and improved multipassage resistor provided by this invention comprises a body of ceramic material or the like of positive temperate coefficient of resistivity (PTC) having a large number of passages extending through the body in side-by-side parallel relation to each other between opposite ends of the body. The passage walls define very thin webs of the resistance material between adjacent passages in the body and the walls of the passages are of uniform thickness from end to end extending right out to the generally flat ends of the resistor body. Slits or slots are formed in the ends of the body extending a short distance into some of the passage walls so that the respective slits communicate with selected pairs of the passages.

Electrically conductive metal coating materials are adhered to the inner walls of the body passages in ohmic contact relation to the material of the resistor body in conventional manner. Electrically conducting interconnecting means are then accommodated in the slits at the ends of the body to electrically interconnect selected groups of the ohmic contact coatings. In one preferred embodiment of this invention, the resistor body is formed of a ceramic, barium titanate-based, resistance material or the like. The slits formed in the ends of the body are arranged so that the slits formed in one end of the body extend between pairs of alternate ones of the body passages and the slits formed in the opposite end of the body extend between pairs of the other body passages. Electrically conductive interconnection coating materials are then applied to the ends of the body so that the conductive material is disposed in each of the body slits. The generally flat ends of the resistor body are then abraded for removing any of the interconnection coating material which may have been disposed on the body ends outside the noted slits. In that way, the ohmic contacts in the alternate body passages are connected together only at one end of the device and the ohmic contacts in the other body passages are interconnected only at the opposite end of the resistor. Accordingly, when the interconnection means of the resistor are connected in series in an electrical circuit, current is directed through the thin webs of resistance material located between ohmic contacts of opposite polarity in adjacent body passages, thereby to generate heat for fast, efficient transfer to gas or other fluid directed through the resistor body passages. The passage walls are adapted to be very thin so that the initial resistance in the webs of resistance material is very low to enhance heating efficiency of the device and to minimize the volume of resistance material required in the device. The resistor body is easily and economically formed with the desired slits and electrically conductive connecting means are easily and reliably accommodated in the slits for interconnecting desired groups of passage coating contacts. The resistor is also of a rugged structure and chipping of the body such as would damage interconnection of the desired groups of contacts or would otherwise render the device defective is less likely to occur.

DESCRIPTION OF THE DRAWINGS

Other objects, advantages and details of the resistor device and method of device manufacture provided by this invention appear in the following detailed description of preferred embodiments of the invention, the detailed description referring to the drawings in which.

DESCRIPTION OF THE PREFERRED EMBODIMENT

Figure 1:
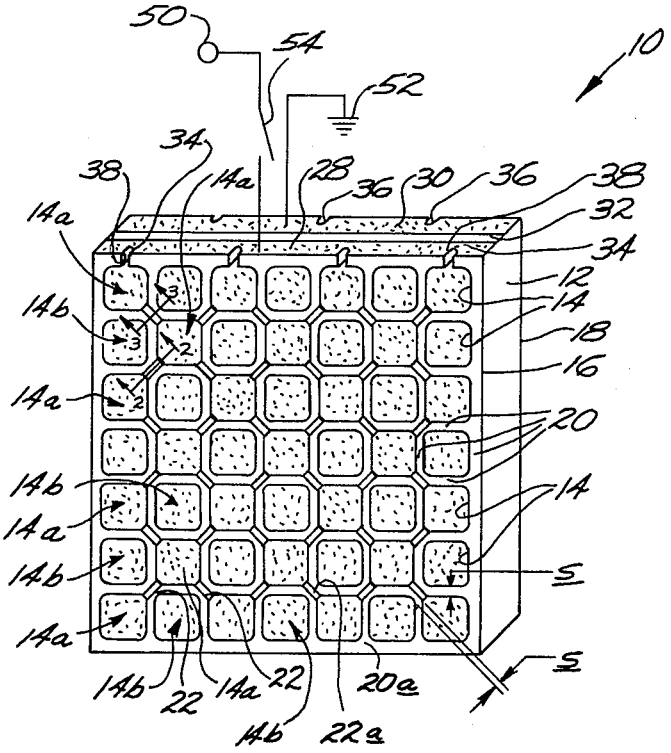
FIG. 1 is perspective view of the resistor device of this invention.
Figure 2:
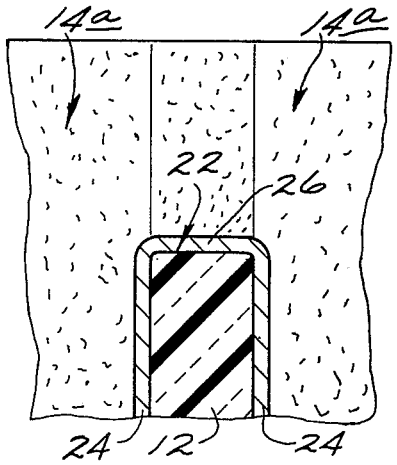
FIG. 2 is a partial section view to enlarged scale along line 2—2 of FIG. 1.
Figure 3:
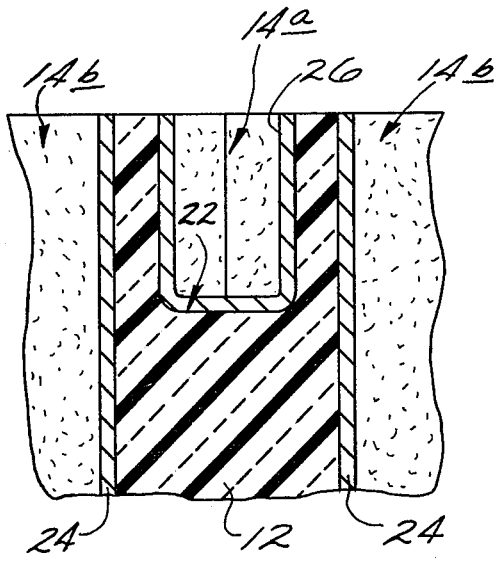
FIG. 3 is a partial section view to enlarged scale along line 3—3 of FIG. 1.
Figure 5:
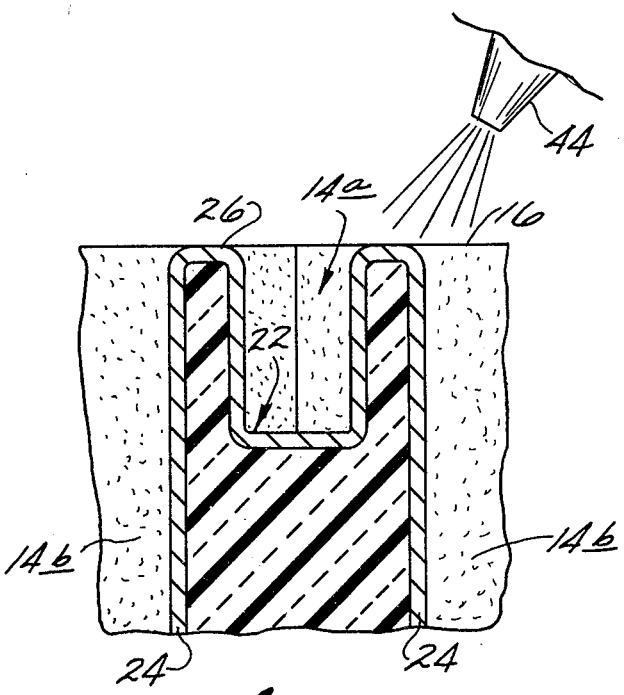
FIGS. 5 and 6 are partial views similar to FIG. 3 diagrammatically illustrating steps in the method of FIG. 4.

Referring to the drawings, 10 in FIGS. 1–3 indicates the novel and improved resistor device of this invention which is particularly adapted for use as a fluid heater. As shown, the device includes a body 12 of a ceramic material or the like of positive temperature coefficient of resistivity. Preferably the body comprises a ceramic material such as lanthanum-doped barium titanate or the like and preferably the material is adapted to display a sharp, anomolous increase in resistivity when the body is heated to a particular temperature. The body has a plurality of passages 14 extending in a pattern between opposite ends 16 and 18 of the body. Typically for example, the body has a large number of passages such as forty-nine (49) or sixty-four (64) and each passage has a generally square or rectangular cross section or the like as shown so that the passage walls 20 form thin webs of resistance material between adjacent passages in the body as shown in FIGS. 1–3.

In accordance with this invention, the passage walls 20 are of substantially uniform thickness end to end extending right out to the generally flat end faces 16 and 18 of the resistor body. That is, the thickness of each of the walls 20 is substantially the same at each of the end faces 16 and 18 as it is in the central part of the resistor body so that the walls have substantial strength at the end faces and so that the end faces of the body are free of chipable portions extending outwardly from the end faces. In that arrangement, the webs of resistance material formed by the passage walls are as functional at the end faces of the resistor body as they are nearer to the center of the resistor device as is more fully discussed below. The walls 20 are also adapted to be relatively thin so that the electrical resistance of each of the thin webs of resistance material between the body passages is quite low at room temperature. Typically, for example, the resistor body 12 is approximately 1.45 inches square, is about 0.25 inches long from end to end, and has forty-nine (49) passages 14 which are each about 0.185 inches square so that the walls 20 between adjacent passages are about 0.020 inches thick. Preferably the passage walls 20*a* of the passages located at the outer sides or periphery of the resistor body 12 are relatively thicker than the webs 20 of material between adjacent passages in the body as indicated in FIG. 1 for improving the shock or physical strength of the resistor body for given resistivity properties of the body. Typically the body 12 is formed of a lanthanum-doped barium titanate material having the empirical formula $Ba_{0.968}Pb_{0.030}La_{0.002}TiO_3$. Such a resistor material has a room temperature resistivity of about 36 ohm-centimeters, a Curie temperature of about 140° C., and displays a sharp, anomolous increase in resistivity to about $10^5$ ohm-centimeters when heated above its anomaly temperature to about 200° C.

In accordance with this invention, the end faces 16 and 18 of the resistor body 12 have slits or notches 22 extending a short distance into the walls 20 between some of the passages 14 at the ends of the passages so that each slit communicates with at least two of the passages and so that selected groups of the passages are interconnected by such slits. In a preferred embodiment of the invention, for example, alternate ones 14*a* of the body passages are connected together by a number of slits 22 located between pairs of the passages 14*a* at one end 16 of the resistor body 12 as shown in FIG. 1. The other body passages 14*b* are similarly interconnected with each other by corresponding slits (not shown) which are located between pairs of the other passages at the opposite end 18 of the resistor body.

In accordance with this invention, the inner walls of the resistor body passages 14 are covered with an adherent, electrically conducting coating 24 which makes ohmic contact with the material of the resistor body 12. The ohmic contact coatings 24 (indicated by stippling in FIGS. 1–3, 5 and 6) are electrically connected together in selected groups by electrically conducting interconnection means 26 (also indicated by stippling) accommodated in the slits 22 and the like at the ends of the body passages. Preferably, for example, the ohmic contacts 24 in alternate ones 14*a* of the body passages are electrically interconnected by conductive interconnection means 26 in the slits 22 at one end 16 of the resistor body as illustrated in FIG. 1. The ohmic contacts 24 in the other body passages 14*b* are electrically connected together by corresponding interconnecting means in similar slits (not shown) located between pairs of said other passages 14*b* at the opposite end 18 of the resistor body as will be understood. Preferably the conductive means interconnecting the groups of ohmic contacts in the passages 14*a* and in the passages 14*b* comprise electrically conductive metal coating material which is adhered to the material of the resistor body 12 within the slits 12 and the like. See FIGS. 2 and 3. Typically, for example, the same coating material used in forming the ohmic contacts 24 is also conveniently used for forming the interconnection means 26 and the like but said interconnection means need not be adhered in ohmic contact relation to the resistor body material as will by understood.

In a preferred embodiment of the resistor device 10, electrically conductive terminal means 28 and 30 are preferably provided in electrically connected relation to the respective groups of interconnected contacts 24 in the body passages. Preferably for example a coating 28 of electrically conductive metal material is adhered to one side 32 of the resistor body 12 and one or more slits 34 are arranged to extend into walls 20*a* of at least one of the alternate body passages 14*a* as shown in FIG. 1. The slits 34 accommodate electrically conductive interconnection means 36 which electrically connect the terminal coating 28 to the group of interconnected contacts 24 in the alternate body passages 14*a*. A similar coating 30 is also adhered to the body side 32, is spaced in electrically insulated relation to the terminal 28, and is electrically connected by conductive interconnection means (not shown) in the slits 38 to the group of interconnected ohmic contacts in said other body passages 14*b* as will be understood. Alternately if desired, the terminals 28 and 30 are formed on respective opposite sides 32 and 33 of the resistor body to permit easier forming of the terminals with less risk that the terminals will be inadvertently connected together as they are being formed. In that arrangement of the resistor heater 10, the terminals 28 and 30 are adapted to be conveniently connected in series in an electrical circuit, whereby electrical current is adapted to be directed from ohmic contacts 24 of one polarity in said alternate passages 14*a* through the thin webs 20 of the resistor body material to ohmic contacts 24 of opposite polarity located in the other, adjacent body passages 14*b* as is further discussed below.

Figure 4:
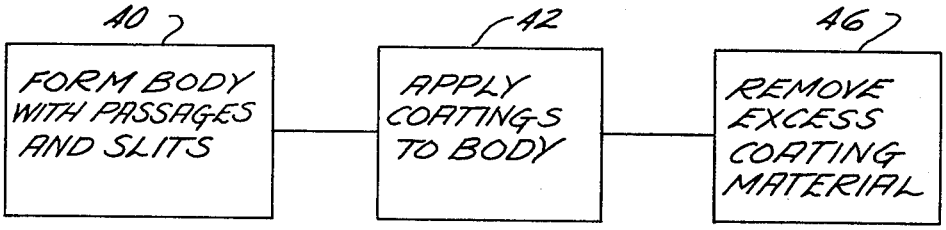
FIG. 4 is a block diagram illustrating the method of this invention.
Figure 6:
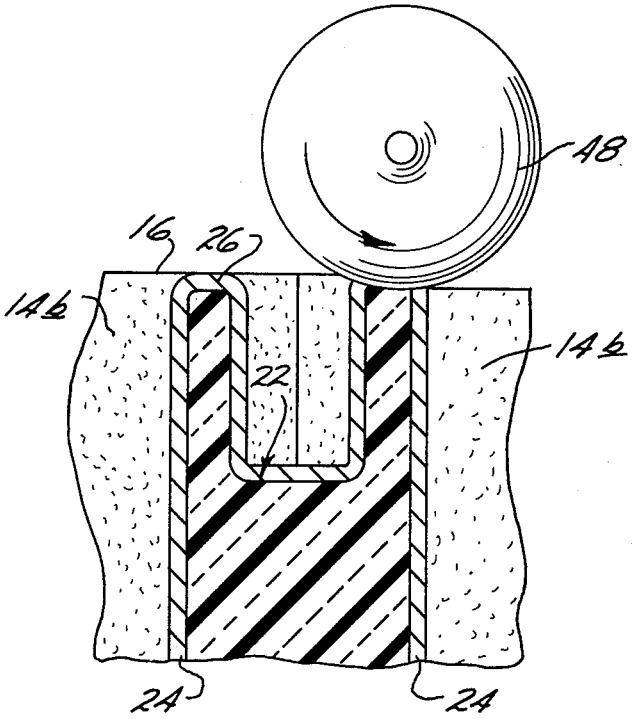

In accordance with the method of this invention, the body 12 is formed with the body passages 14 and with the slits 22, 34 and 38 and the like in any conventional manner as is diagrammatically illustrated at 40 in FIG. 4. Preferably for example the body is formed by conventional molding process such as is shown in U.S. Pat. No. 3,790,654. Preferably also the slits 22, 34 and 38 and the like are formed in the body in any conventional way during such molding. Alternately however the body 12 is molded with the passages 14 therein and the noted slits are then formed in the body by cutting or abrading or the like in any conventional way. If desired, a body having passages 14 formed therein is molded to a substantial length and is then cut into shorter lengths to form a plurality of the bodies 12 as will be understood. The noted slits are then cut into the bodies as noted above. Where the resistor body is formed with an even number of the passages 14, the noted slits are preferably formed in the opposite ends of the body so that the opposite body ends are mirror images of each other to facilitate manufacture and subsequent processing of the resistor bodies. In accordance with this invention, the ohmic contact coatings 24 and the interconnection coatings 26 and the like, as well as the terminal coatings 28 and 30 and the additional interconnection coatings 36 and the like are applied to the resistor body 12 in any conventional manner within the scope of this invention as is diagrammatically illustrated at 42 in FIG. 4. That is, the coating materials are applied by spraying, brush coating, dip coating or electroless plating or the like with or without the use of temporary masking as may be desired within the scope of this invention. In a preferred embodiment, the coating materials are most conveniently applied by spraying or the like as is indicated diagrammatically at 44 in FIG. 5 so that the materials cover the passage walls 20 and are disposed in the slits 22 and the like and on the ends 16 and 18 of the body. Preferably the coating materials deposited on the inner walls of the body passages are subjected to heat treatments in conventional manner for making improved ohmic contact to the ceramic material of the resistor body. As such coating materials are well known, and are described in U.S. Pat. No. 3,676,211 for example, they are not further described herein and it will be understood that the coatings are electrically conducting, the coatings on the passage walls are in ohmic contact to the body material, the terminal coatings adhere to the body, and the interconnection coatings are disposed in the body slits 22, 36 and 38 and the like for electrically interconnecting desired groups of the ohmic contacts to each other and to the terminals.

In accordance with this invention, the ends of the resistor body are preferably treated in any conventional manner as is diagrammatically indicated at 46 in FIG. 4 for removing any excess of the interconnecting coating materials from the ends of the resistor body outside the slits 22 and the like. Preferably for example the interconnection coating materials are liberally applied over the ends of the resistor body so that the conductive interconnection coating material is assuredly disposed in all of the noted body slits and so that substantially all of the ohmic contacts 24 are connected to all of the other contacts at each end of the body. The ends 16 and 18 of the body are then abraded in a conventional manner as is diagrammatically illustrated at 48 in FIG. 6 for removing the interconnection coating material from the body ends while leaving the material in the slits 22, 34 and 38 and the like for interconnecting desired pairs of ohmic contact coatings 24 and for connecting such coatings to the terminals 28 and 30.

In that procedure, the resistor body is easily formed with the desired passages and slits therein. The desired coating materials are easily applied and, by the use of a simple abrading step or the like, any excess interconnecting coating material is easily and reliably removed to leave the ohmic contacts interconnected in desired groups. Since the ends of the resistor body are free of upstanding lands or the like, the resistor body is easily and reliably formed. It is also free of chippable portions so that the body is easily handled during further processing and use without excessive risk of chipping damage to the device. The passage walls are adapted to be as thin as may be desired and no otherwise undesired wall thickness has to be provided to accommodate lands or the like at the end of the body passages. That is, the passage walls have the same thickness throughout the length of the passage out to the ends 16 and 18 of the resistor body. The device is therefore adapted to provide very low initial resistance if desired and requires a limited volume of the ceramic material for achieving a desired heat output capacity.

In a preferred embodiment of the invention, the passages 14 preferably have rounded corners as shown in FIG. 1 and the slits 22 and the like are located and proportioned as shown in FIG. 1 so that the slits accommodate a substantial amount of the interconnecting coating materials but so that the interconnecting coating means in the slits have a spacing s relative to adjacent ohmic contacts 24 which is comparable to the spacing s′ of the contacts from each other. Preferably also a large number of the slits 22, 34, and 38 and the like are provided so that there are redundant interconnections between desired groups of the contacts as indicated at 22*a* in FIG. 1 and so that there are redundant connections between the contacts and the terminals. In that way, improved reliability of the desired interconnections between groups of contacts is achieved; the current loads from the terminals to the individual contacts 24 never exceed the current carrying capacity of the interconnection coatings; and excessive heating or the like of the ceramic resistance material adjacent to the interconnection slits is avoided.

It should be understood that although preferred embodiments of the novel and improved resistor and method of this invention have been described in detail for illustrating the invention, this invention includes all modifications and equivalents of the described embodiments falling within the scope of the appended claims.

I claim:

1. A resistor device comprising a body of resistor material of positive temperature coefficient of resistivity having a plurality of passages extending through the body in spaced side-byside relation to each other in a selected pattern defining thin webs of the resistor body material which are of substantially uniform thickness between adjacent passages from end to end of the resistor body, said body having slits located in said webs at ends of the passages so that the respective slits communicate with selected pairs of the passages, electrically conductive means on inner walls of the body passages in ohmic contact relation to the resistor body material, and electrically conducting interconnecting means disposed in said slits electrically connecting selected groups of said ohmic contact means together, whereby, when groups of the contact means are connected in a circuit, current is directed through thin webs of resistor body material between ohmic contact means of opposite polarity in adjacent body passages.

2. A resistor device as set forth in claim 1 having electrically conductive terminal means disposed on side portions of the resistor body, having additional slits located in said side portions of the body extending into at least some of the passages at ends of the passages, and having additional electrically conducting interconnecting means disposed in the additional slits electrically connecting the terminal means to said respective groups of ohmic contact means.

3. A self-regulating resistor heater device comprising a body of ceramic resistor material of positive temperature coefficient of resistivity which is adapted to display a sharp, anomolous increase in resistivity when heated to a predetermined temperature, said body having a plurality of passages extending through the body between ends of the body in spaced, side-by-side relation to each other in a selected pattern defining thin webs of the resistor body material which are of substantially uniform thickness between adjacent passages from end to end of the resistor body, said body having first slits located at one end of the body in said webs of resistor material at the ends of alternate ones of the body passages so that the respective first slits communicate with selected pairs of said alternate passages, said body having second slits located at the opposite end of the body in said webs of resistor material at the ends of the others of said body passages so that the respective second slits communicate with selected pairs of said other passages, coatings of electrically conductive material on inner walls of the body passages in ohmic contact relation to the resistor body material, and electrically conducting interconnecting coating material adhering to the resistor body material within said first slits electrically connecting the ohmic contact coatings in the alternate body passages together and within said second slits electrically connecting the ohmic contact coatings in said other body passages together, whereby, when said interconnected groups of contact coatings are connected in a circuit, current is directed through the thin webs of resistor body material between ohmic contact coatings of opposite polarity in adjacent passages for generating heat and for permitting the temperature of the device to self-regulate and stabilize as the resistivity of the resistor body material increases.

4. A resistor heater device as set forth in claim 3 having electrically conducting terminal coating material adhering to side portions of the resistor body forming a pair of device terminals, having additional slits located in said side portions of the body extending into at least some of said alternate passages and some of said other passages at the ends of the passages, and having additional electrically conducting interconnecting coating means adhering to the resistor body material within said additional slits electrically connecting the group of ohmic contact coatings in said alternate passages and the group of ohmic contact coatings in said other passages to the respective device terminals.

5. A resistor heater device as set forth in claim 4 wherein the passages disposed along the outer sides of the resistor body have walls located along the outer sides of the body which are relatively thicker than the thin webs of resistor body material disposed between adjacent passages in the body for improving the physical strength of a device having selected resistivity characteristics.

6. A resistor heater device as set forth in claim 5 wherein said terminal coating material is adhered to two portions of the same side of the resistor body for forming said pair of device terminals in spaced electrically insulated relation to each other on said side of the resistor body.

7. A resistor heater device as set forth in claim 5 wherein a plurality of said additional interconnecting means electrically connect each of said groups of ohmic contact coatings to the respective device terminals.

8. A resistor heater device as set forth in claim 7 having electrically conducting interconnecting coating materials in at least some of said first and second slits providing redundant electrical interconnection of some of said ohmic contact coatings in said groups of interconnected contact coatings for providing improved device reliability.

9. A method for making a resistor device comprising the steps of providing a body of resistor material of positive temperature coefficient of resistivity having a plurality of passages extending through the body in spaced, side-by-side relation to each other in a selected pattern defining thin webs of the resistor body material which are of substantially uniform thickness between adjacent passages from end to end of the resistor body and having slits located in said webs at the ends of the passages so that the respective slits communicate with selected pairs of the passages, depositing electrically conductive means on inner walls of the body passages in ohmic contact relation to the resistor body material, and disposing electrically conducting interconnecting means in said slits electrically connecting selected groups of said ohmic contact means together so that when said groups of contact means are connected in a circuit, current is directed through thin webs of the resistor body material between ohmic contact means of opposite polarity in adjacent body passages.

10. A method as set forth in claim 9 wherein said electrically conducting interconnection means comprise electrically conducting interconnection coating materials which are deposited on the ends of the resistor body to be received in said slits for electrically interconnecting said ohmic contact means, and wherein end portions of said resistor body are abraded for removing said interconnection coating materials from said resistor body end portions outside of said slits to leave said ohmic contact coatings interconnected in said selected groups.

11. A method as set forth in claim 10 wherein said body has additional slits located in side portions thereof extending into at least some of the passages at ends of the passages, electrically conducting terminal coating means are disposed on said side portions of the body to form a pair of resistor device terminals, and additional electrically conducting interconnecting means are disposed in the additional slits electrically connecting the terminals to said respective groups of ohmic contact means.

12. A method for making a self-regulating resistor heater device comprising the steps of providing a body of a ceramic resistor material of positive temperature coefficient of resistivity which is adapted to display a sharp, anomolous increase in resistivity when heated to a predetermined temperature, said body having a plurality of passages extending through the body in spaced side-by-side relation to each other in a selected pattern defining thin webs of the resistor body material which are substantially uniform thickness between adjacent passages from end to end of the resistor body having first slits located at one end of the body extending into said webs of resistor material at the ends of alternate ones of the body passages so that respective first slits communicate with selected pairs of said alternate passages, having second slits located at the opposite end of the body extending into said webs of resistor material at the ends of the others of said passages so that respective second slits communicate with selected pairs of said other passages, and having additional slits located in side portions of the body extending into at slits some of the body passages at the ends of the passages, depositing electrically conductive means on inner walls of the body passages in ohmic relation to the resistor body material, depositing electrically conductive terminal coating materials on said side portions of the body for forming a pair of device terminals, depositing electrically conducting interconnection coating material on the ends of the resistor bdy to be received in said first, second and additional slits and adhered to the resistor body material within the slits in electrically connected relation to said ohmic contact and terminal coatings, and abrading the ends of the resistor body for removing said interconnection coating materials from the body ends outside said slits for leaving the ohmic contact coatings in said alternate passages interconnected to each other and to one of said terminals and for leaving the ohmic contact coatings in the other passages interconnected to each other and to the other device terminal.

* * * * *